US010167668B1

(12) United States Patent
Wang

(10) Patent No.: US 10,167,668 B1
(45) Date of Patent: Jan. 1, 2019

(54) WORK LADDER USED AS WORKING PLATFORM

(71) Applicant: Ningbo Xingfu Tools Co., Ltd., Ningbo (CN)

(72) Inventor: Wanxing Wang, Ningbo (CN)

(73) Assignee: Ningbo Xingfu Tools Co., Ltd., Ningbo (CN)

( * ) Notice: Subject to any disclaimer, the term of this patent is extended or adjusted under 35 U.S.C. 154(b) by 50 days.

(21) Appl. No.: 15/549,340

(22) PCT Filed: May 12, 2015

(86) PCT No.: PCT/CN2015/000325
§ 371 (c)(1),
(2) Date: Aug. 7, 2017

(87) PCT Pub. No.: WO2016/119088
PCT Pub. Date: Aug. 4, 2016

(30) Foreign Application Priority Data

Jan. 27, 2015 (CN) ..... 2015 1 0040604

(51) Int. Cl.

| | |
|---|---|
| ***E06C 1/16*** | (2006.01) |
| ***E06C 1/393*** | (2006.01) |
| ***E06C 1/387*** | (2006.01) |
| ***B25H 1/04*** | (2006.01) |

(Continued)

(52) U.S. Cl.
CPC ..... *E06C 1/393* (2013.01); *B25H 1/04* (2013.01); *E06C 1/16* (2013.01); *E06C 1/387* (2013.01); *E06C 7/08* (2013.01); *E06C 7/082* (2013.01); *E06C 7/16* (2013.01)

(58) Field of Classification Search
CPC . E06C 1/393; E06C 1/16; E06C 1/387; E06C 7/08; E06C 7/082; E06C 7/16
See application file for complete search history.

(56) References Cited

U.S. PATENT DOCUMENTS 382,102 A * 5/1888 McLaughlin
5,722,507 A * 3/1998 Kain ..... E06C 1/393 182/104

(Continued)

FOREIGN PATENT DOCUMENTS

FR 2133045 A5 * 11/1972 ..... E06C 1/393

*Primary Examiner* — Alvin C Chin-Shue
(74) *Attorney, Agent, or Firm* — Wang Law Firm, Inc.

(57) ABSTRACT

A working ladder capable of serving as a working platform, comprises a ladder frame body having a front portion and a top; and a step assembly. The step assembly comprises at least a bottom step and an upper step located above the bottom step; the rear shaft comprises a bottom rear shaft and an upper rear shaft; two movable auxiliary support rods capable of swinging up and down are disposed in the front portion of the ladder frame body; an auxiliary shaft for the rear end of the bottom step to rest on is horizontally disposed on the top of the ladder frame body; when the auxiliary support rods are in a downward position, the rear end of the bottom step rests on the lowermost bottom rear shaft; when the auxiliary support rods are in a upwardly position, the bottom step moves upwardly to the top of the ladder frame body, and meanwhile the rear end of the bottom step rests on the auxiliary shaft. The steps of the working ladder can be used as working platforms.

10 Claims, 7 Drawing Sheets

(51) Int. Cl.
*E06C 7/08* (2006.01)
*E06C 7/16* (2006.01)

(56) References Cited

U.S. PATENT DOCUMENTS 7,182,176 B2 * 2/2007 Gibson ..... A47C 12/00
182/129
9,869,125 B2 * 1/2018 Simpson ..... E06C 1/387

* cited by examiner

WORK LADDER USED AS WORKING PLATFORM

RELATE APPLICATIONS

This application is a national phase entrance of and claims benefit to PCT Application for a working ladder capable of serving as a working platform, PCT/CN2015/000325, filed on May 12, 2015, which claims benefit to Chinese Patent Application 201510040604.3, filed on Jan. 27, 2015. The specifications of both applications are incorporated here by this reference.

TECHNICAL FIELD OF THE INVENTION

The present invention relates to a ladder, and in particular to a working ladder capable of serving as a working platform.

BACKGROUND OF THE INVENTION

Ladders are common tools for climbing high for fetching something or for maintenance in daily life. Ladders are roughly classified into two categories. One category is straight ladders. Such a ladder comprises two upright poles and cross rails erected between the two upright poles. These ladders may be used vertically only. The ladders need to be leaned against a fixed position to support the ladders when in use. Moreover, the ladders have a single function of climbing high. If such ladders are used for maintenance, a person has to climb up and down the ladders to pick up or put down tools for many times, so that it is very inconvenient. Another category is herringbone ladders. Majority of such ladders consist of a main ladder frame and a support ladder frame, which are hinged together on their tops. Compared with the straight ladders, the herringbone ladders can support climbing operations overhead.

Existing ladders have no large working platform on their tops, so they cannot be used as a working platform. A working platform allows a user to perform operations such as sawing, cutting or carving on this platform.

A Chinese Patent CN202125241U, entitled WORKING PANEL AND WORKING PLATFORM LADDER WITH SAME, has disclosed a ladder capable of serving as a working platform. The ladder comprises three ladder frame segments. Each of the ladder frame segments comprises two opposite side rails arranged at intervals, and a number of cross rails arranged between the two side rails. The side rails of two adjacent ladder frame segments are rotatably connected together by a hinge mechanism. Support legs are provided on the bottoms of two outermost ladder frame segments, respectively. A working panel is placed within the middle ladder frame segment to form a working platform. Although the ladder may serve as a working platform, a dependent working panel needs to be additionally provided; and the working panel is separated from the ladder so that the working panel may be easily lost or left behind

SUMMARY OF THE INVENTION

A technical problem to be solved by the present invention is to provide a working ladder, the steps of which can be used as working platforms. New application has been obtained for the working ladder of the present invention, which makes the working ladder more humanized.

To solve the above stated technical problem, the working ladder capable of serving as a working platform comprises a ladder frame body which can be expanded and folded, having a front portion and a top; and a step assembly which is disposed on the ladder frame body and able to be folded; wherein, the step assembly comprises at least two steps, each step having a front end and a rear end, arranged one above another at intervals, and a rear shaft for the rear end of each step to rested on; the bottommost step is a bottom step, and a step located above the bottom step is an upper step; the rear shaft comprises a bottom rear shaft for the rear end of the bottom step, and an upper rear shaft for the rear end of the upper step;

two movable auxiliary support rods capable of swinging up and down are disposed in the front portion of the ladder frame body, the front end of the bottom step is rotatably disposed between the two movable auxiliary support rods, and an auxiliary shaft for the rear end of the bottom step to rest on is horizontally disposed on the top of the ladder frame body; when the auxiliary support rods are in a downward position, the rear end of the bottom step rests on the lowermost bottom rear shaft; when the auxiliary support rods are in a upwardly position, the bottom step moves upwardly to the top of the ladder frame body, and meanwhile the rear end of the bottom step rests on the auxiliary shaft.

Preferably, the ladder frame body comprises a pair of front side rails and a pair of rear side rails, the side rails of each pair are separated from each other into two sides, two side rails on a same side are hinged together, and the auxiliary support rods are rotatably arranged on front end surfaces of the front side rails. The forgoing description shows a conventional structure of the ladder frame body of the working ladder. Of course, a ladder frame structure of other existing working ladders can also be used.

Preferably, the front end of the upper step is rotatably disposed between the two front side rails; the upper rear shaft is fixed between the two rear side rails; two upper connecting rods are rotatably connected to left and right sides of the upper step adjacent to the bottom step; two lower connecting rods are rotatably connected to lower portions of the two rear side rails; and, an end of an upper connecting rod and an end of a lower connecting rod on a same side are both rotatably connected to one side of the bottom rear shaft through a rotating shaft. The folding of the step assembly can be realized by rotation of the upper and lower connecting rods. The structure for folding the steps is simple and rational. If there are many upper steps, left and right sides of other adjacent upper steps are rotatably connected together by connecting rods, so that the synchronous folding of those steps is realized. Of course, there are many structures for folding the step assembly, and these structures can refer to the prior art.

Preferably, each of the two front side rails is fixed with an U-shaped fixed plates; the left and right sides of the front end of the upper step are rotatably disposed on the fixed plates, respectively; the auxiliary support rods are rotatably disposed within U-shaped grooves of the fixed plates. The fixed plates provide proper mounting positions for the upper step, especially for the movable auxiliary support rods, so that the structure of the front side rails can be simplified.

Preferably, the top of the front side rail and the top of the rear side rail on a same side are hinged together through a connecting member which is fixed on the top of the front side rail; and the top of the rear side rail is rotatably connected to the connecting member. The arrangement of the connecting members can provide a mounting position for the auxiliary shaft, that is, the auxiliary shaft can be fixed between the two connecting members. Of course, the front side rails and the rear side rails can also be directly hinged together.

To be convenient to have the working ladder folded and turn the bottom step to the upper portion of the ladder frame body to serve as a working platform, preferably, a first bore forming a first handle for pulling the bottom step is formed on the bottom step, and a second bore forming a second handle for pulling the upper step is formed on the upper step. When the working ladder is to be folded, it is just needed to put a hand into the bores and then pull the bottom step and the upper step.

To ensure that the adjacent upper step will not obstruct a person's legs when the person stands on the bottom step, preferably, the front end surface of the upper step adjacent to the bottom step is arranged with recessed sections which are bent inwardly. Thus, when a person stands on the bottom step, his/her legs will get into the recessed sections, so that the upper step will not obstruct the person's legs and it is thus convenient for the person to stand on the bottom step.

Preferably, a connection structure for detachably connecting the bottom rear shaft or the auxiliary shaft is disposed on the bottom surface of the bottom step. By connecting the connection structure to the bottom rear shaft or the auxiliary shaft, the bottom step can lock the working ladder when serving as a step, so that the working ladder is prevented from being folded unexpectedly; and, when serving as a working platform, the bottom step can lock and also stabilize the working platform, so that the working platform is prevented from being turned over unexpectedly.

Preferably, the connection structure comprises two holders and a driving structure for driving the holders to slide front and back; limiting openings running through a width direction of the bottom step and having a shape matched with the bottom rear shaft or the auxiliary shaft are disposed on the bottom surface of the bottom step; the holders are positioned on the bottom surface of the bottom step and are able to slide front and back; two stoppers extending to the underneath of the limiting openings are disposed in rear portions of the holders; when the bottom rear shaft or the auxiliary shaft is located within the limiting openings, the stoppers are located below the bottom rear shaft or the auxiliary shaft. By the fitting of the limiting openings and the stoppers on the holders, the bottom rear shaft or the auxiliary shaft is restricted below the bottom step so as to position the bottom step. Of course, other structures for restricting the bottom step onto the bottom rear shaft or the auxiliary shaft can also be designed as desired.

Preferably, the driving structure comprises a pull rod attached to the holders, and the pull rod is positioned on the bottom surface of the bottom step and able to slide front and back; a handle is connected to a tail end of the pull rod, and the handle is also positioned on the bottom surface of the bottom step and able to slide front and back; the pull rod is U-shaped, and one of the holders is fixed on each of two straight rod portions of the pull rod; the handle is connected to a middle portion of a horizontal rod portion of the pull rod. By providing the two holders, the bottom step can be more firmly positioned onto the bottom rear shaft or the auxiliary shaft. Meanwhile, the driving structure can drive the driven holders to slide simply by pushing or pulling the handle, so that the bottom step is locked onto or unlocked from the bottom rear shaft or the auxiliary shaft. To maintain the holders in a locked state, springs for maintaining the holders in the locked state can be disposed in the rear portions of the holders.

Compared with the prior art, the present invention has the following advantages: since the bottom step can be turned over to the top of the ladder frame body and an auxiliary shaft for the bottom step to rested on is disposed on the top of the ladder frame body, the bottom step can serve as a step, and also can serve as a working platform when the bottom step is turned over to the top of the ladder frame and rested on the auxiliary shaft, so that a user is allowed to perform various operations such as sawing, cutting or carving on this platform.

DETAILED DESCRIPTION OF THE INVENTION

Figure 1:
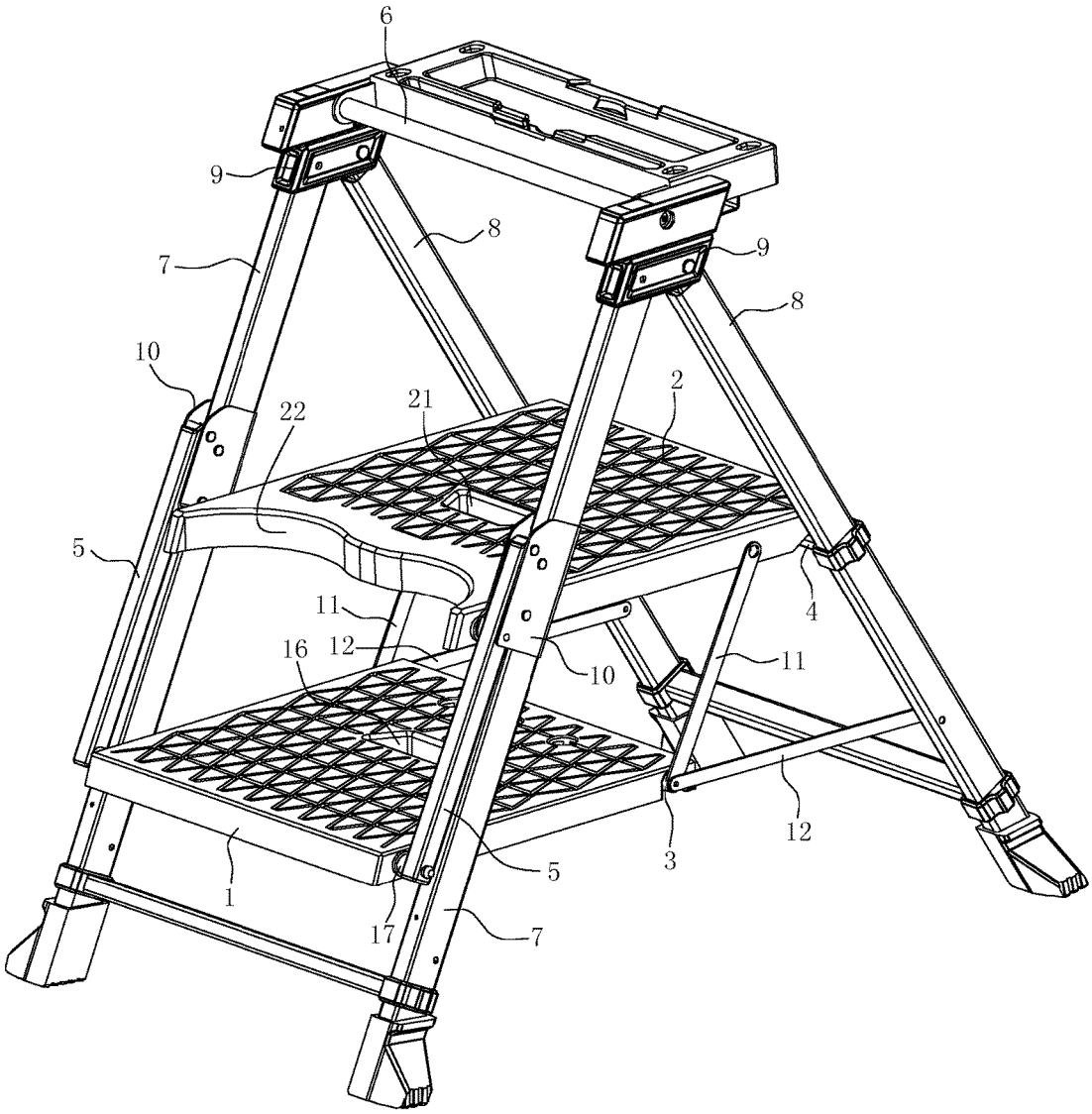
FIG. 1 is a perspective view of a working ladder capable of serving as a working platform according to an embodiment of the present invention (when the working ladder is used)

To enable a further understanding of the present invention content of the invention herein, refer to the detailed description of the invention and the accompanying drawings below:

FIG. 1-FIG. 7 show a preferred embodiment of the present invention.

A working ladder capable of serving as a working platform, comprises: a ladder frame body which can be expanded and folded, having a front portion and a top; and a step assembly which is disposed on the ladder frame body and able to be folded.

The ladder frame body comprises a pair of front side rails 7 and a pair of rear side rails 8, the side rails of each pair are separated from each other into two sides; the top of the front side rail 7 and the top of the rear side rail 8 on a same side are hinged together through a connecting member 9 which is fixed on the top of the front side rail 7, and the top of the rear side rail 8 is rotatably connected to the connecting member 9; support rods are disposed between the two front side rails 7 and also disposed between the two rear side rails 8.

The step assembly comprises at least two steps, each step having a front end and a rear end, arranged one above another at intervals, and a rear shaft for the rear end of each step to rest on; a bottommost step is a bottom step 1, and the step located above the bottom step 1 is an upper step 2, there is only one upper step 2 in this embodiment; the rear shaft comprises a bottom rear shaft 3 for the rear end of the bottom step 1 and an upper rear shaft 4 for the rear end of the upper step 2.

Two movable auxiliary support rods 5 capable of swinging up and down are disposed in the front portion of the ladder frame body; the movable auxiliary support rods 5 are rotatably disposed on front end surfaces of the front side rails 7; each of the two front side rails 7 is fixed with an U-shaped fixed plates 10; U-shaped grooves of the fixed plates 10 are arranged forward, and the auxiliary support rods 5 are rotatably disposed within the U-shaped grooves of the fixed plates 10.

The front end of the bottom step 1 is rotatably disposed between the two auxiliary support rods 5 through a rotating shaft 17; an auxiliary shaft 6 for the rear end of the bottom step 1 to rest on is horizontally disposed on the top of the ladder frame body; the auxiliary shaft 6 can be disposed between the two connecting members 9, or can be disposed on connecting arms on two sides of a tool box, as long as the auxiliary shaft is horizontally disposed in the upper portion of the ladder frame body; a first bore 16 forming a first handle for pulling the bottom step 1 is formed on the bottom step 1; the front end surface of the upper step 2 adjacent to the bottom step is arranged with recessed sections 22 which are bent inwardly, the recessed sections 22 are matched with the shape of two legs of a person in shape.

The front end of the upper step 2 is rotatably disposed between the two front side rails 7; the left and right sides of the front end of the upper step 2 are rotatably disposed on the fixed plates 10, respectively; the upper rear shaft 4 is fixed between the two rear side rails 8; two upper connecting rods 11 are rotatably connected to the left and right sides of the upper step 2 adjacent to the bottom step 1; two lower connecting rods 12 are rotatably connected to lower portions of the two rear side rails 8; an end of an upper connecting rod 11 and an end of a lower connecting rod 12 on a same side are both rotatably connected to one side of the bottom rear shaft 3 through a rotating shaft; a second bore 21 forming a second handle for pulling the upper step 2 is formed on the upper step 2.

When the auxiliary support rods 5 are in a downward position, the rear end of the bottom step 1 rests on the lowermost bottom rear shaft 3; when the auxiliary support rods 5 are in a upwardly position, the bottom step 1 moves upwardly to the top of the ladder frame body, and meanwhile the rear end of the bottom step 1 rests on the auxiliary shaft 6.

A connection structure for detachably connecting the bottom rear shaft 3 or the auxiliary shaft 6 is disposed on the bottom surface of the bottom step 1.

Figure 3:
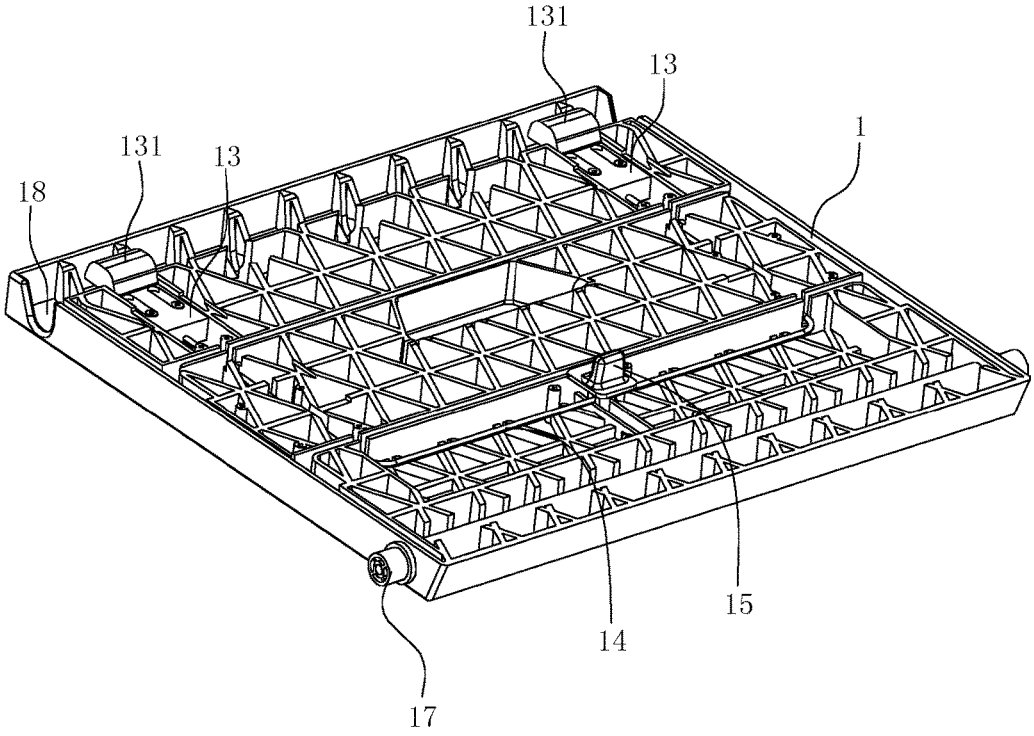
FIG. 3 is a perspective view of a bottom step with the connection structure according to the embodiment of the present invention.
Figure 4:
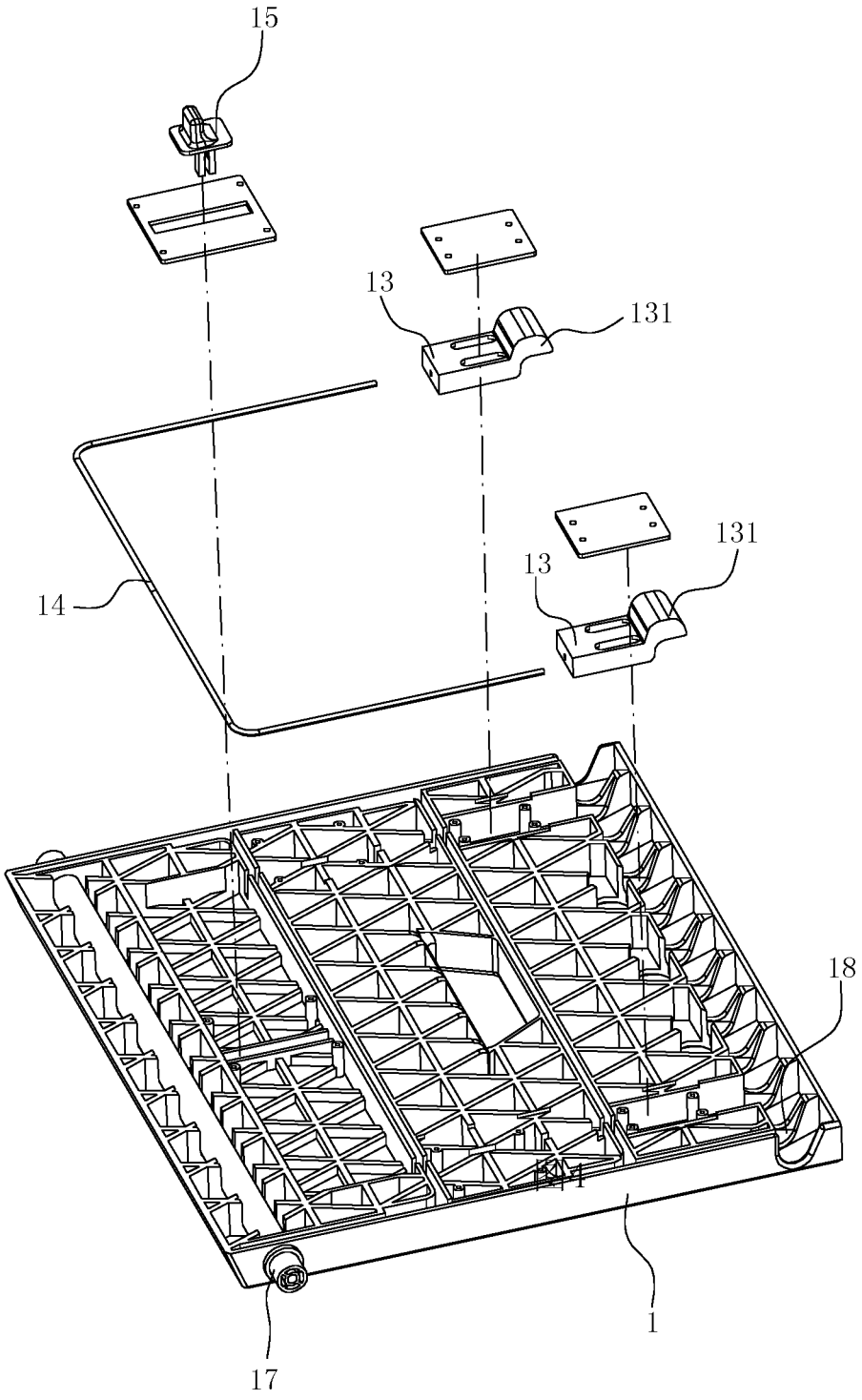
FIG. 4 is an exploded view of the bottom step with the connection structure according to the embodiment of the present invention.

As shown in FIGS. 3 and 4, the connection structure comprises two holders 13 and a driving structure for driving the holders 13 to slide front and back; limiting openings 18 running through a width direction of the bottom step and having a shape matched with the bottom rear shaft 3 or the auxiliary shaft 6 are disposed on the bottom surface of the bottom step 1; the holders 13 are positioned on the bottom surface of the bottom step 1 and are able to slide front and back; two stoppers 131 extending to the underneath of the limiting openings 18 are disposed in rear portions of the holders 13; when the bottom rear shaft 3 or the auxiliary shaft 6 is located within the limiting openings 18, the stoppers 131 are located below the bottom rear shaft 3 or the auxiliary shaft 6.

The driving structure comprises a pull rod 14 attached to the holders 13, and the pull rod 14 is positioned on the bottom surface of the bottom step 1 and able to slide front and back; a handle 15 is connected to a tail end of the pull rod 14, and the handle 15 is also positioned on the bottom surface of the bottom step 1 and able to slide front and back; the pull rod 14 is U-shaped, and one of the holders 13 is fixed on each of two straight rod portions of the pull rod 14; the handle 15 is connected to a middle portion of a horizontal rod portion of the pull rod 14.

The working principle and process of the working ladder are as follows.

Figure 2:
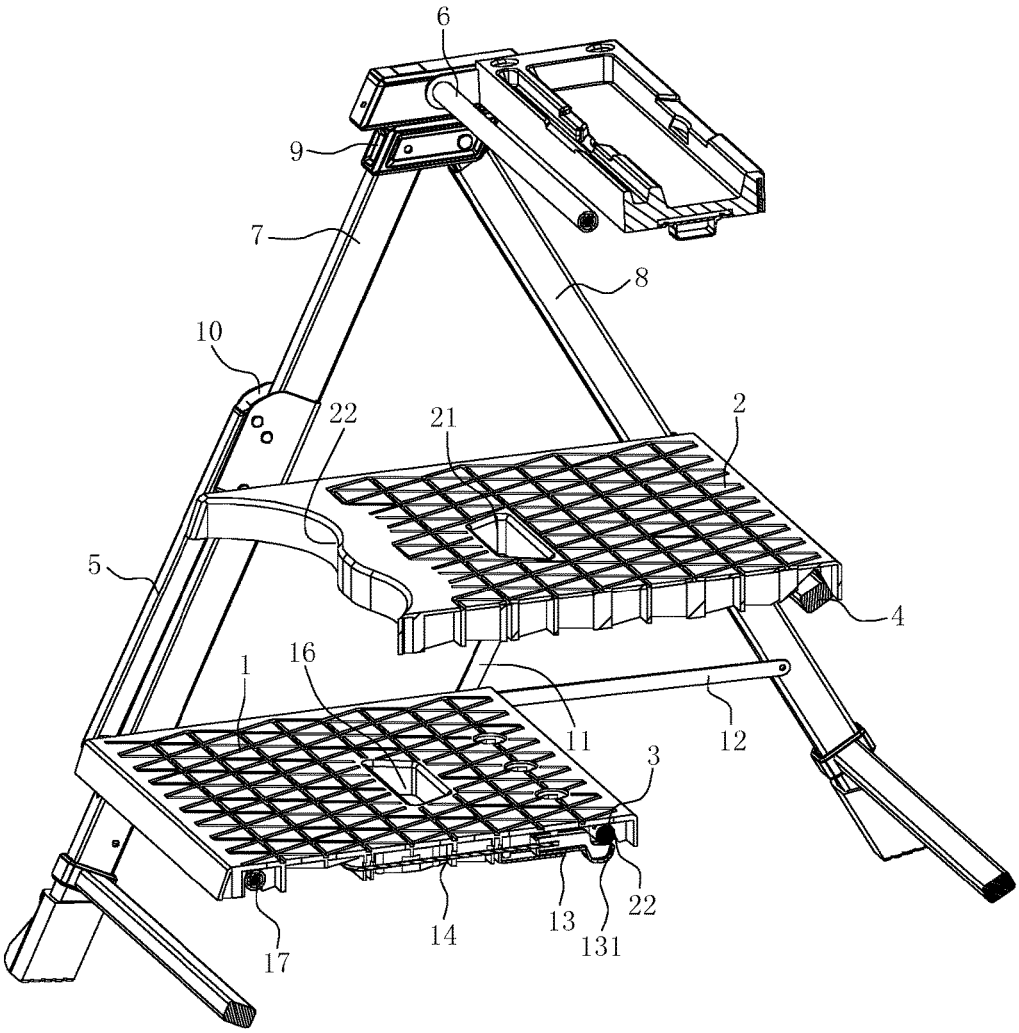
FIG. 2 is a perspective view of the working ladder of FIG. 1 when one portion of the working ladder is cut off.

As shown in FIGS. 1 and 2, when the working ladder serves as a ladder, the ladder frame body is expanded, the rear end of the upper step 2 rests on the upper rear shaft 4. Meanwhile, when the movable auxiliary support rods 5 are turned down, the rear end of the bottom step 1 rests on the lowermost bottom rear shaft 3, the bottom rear shaft 3 is inserted into the limiting openings 18 of the bottom step 1, and the stoppers 131 of the holders 13 are located below the bottom rear shaft 3. In this case, the bottom step 1 serves as a step.

Figure 5:
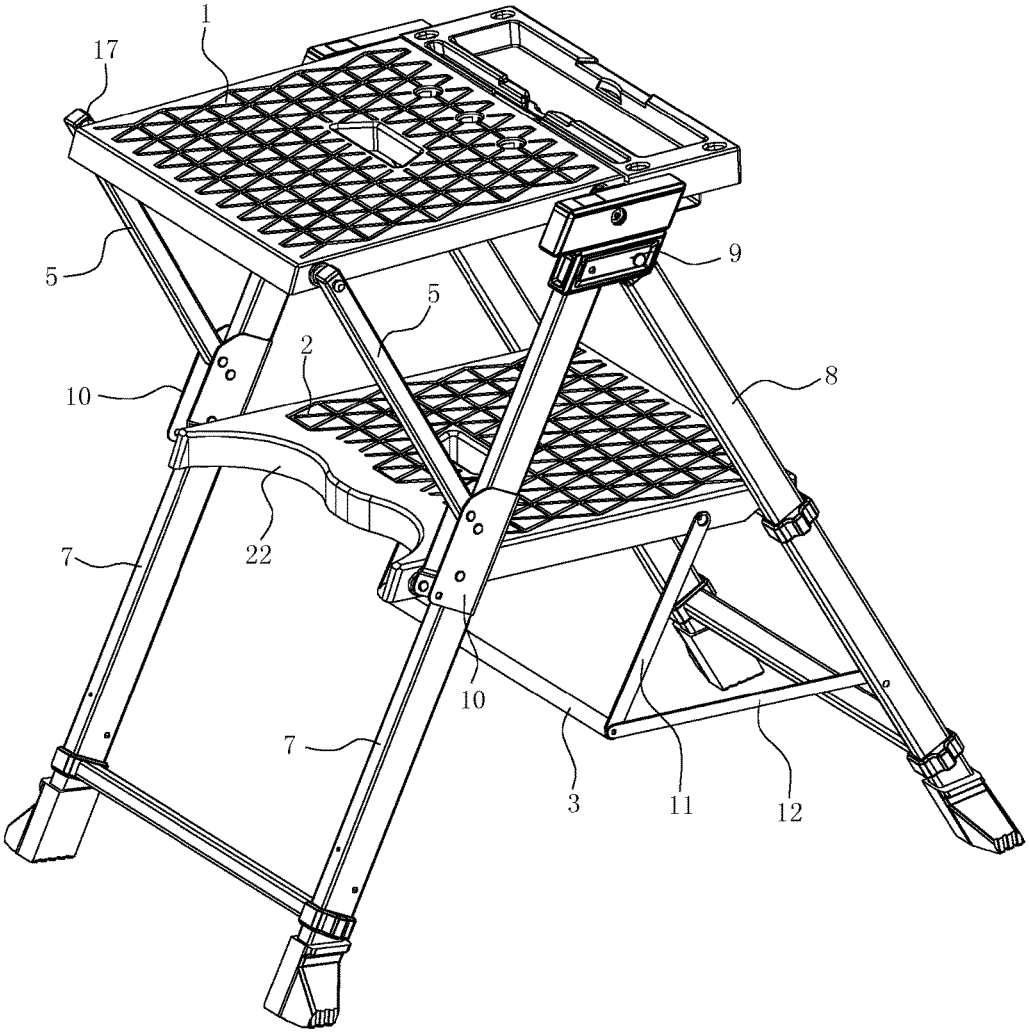
FIG. 5 is another perspective view of the working ladder according to the embodiment of the present invention (when the working platform is in another status)
Figure 6:
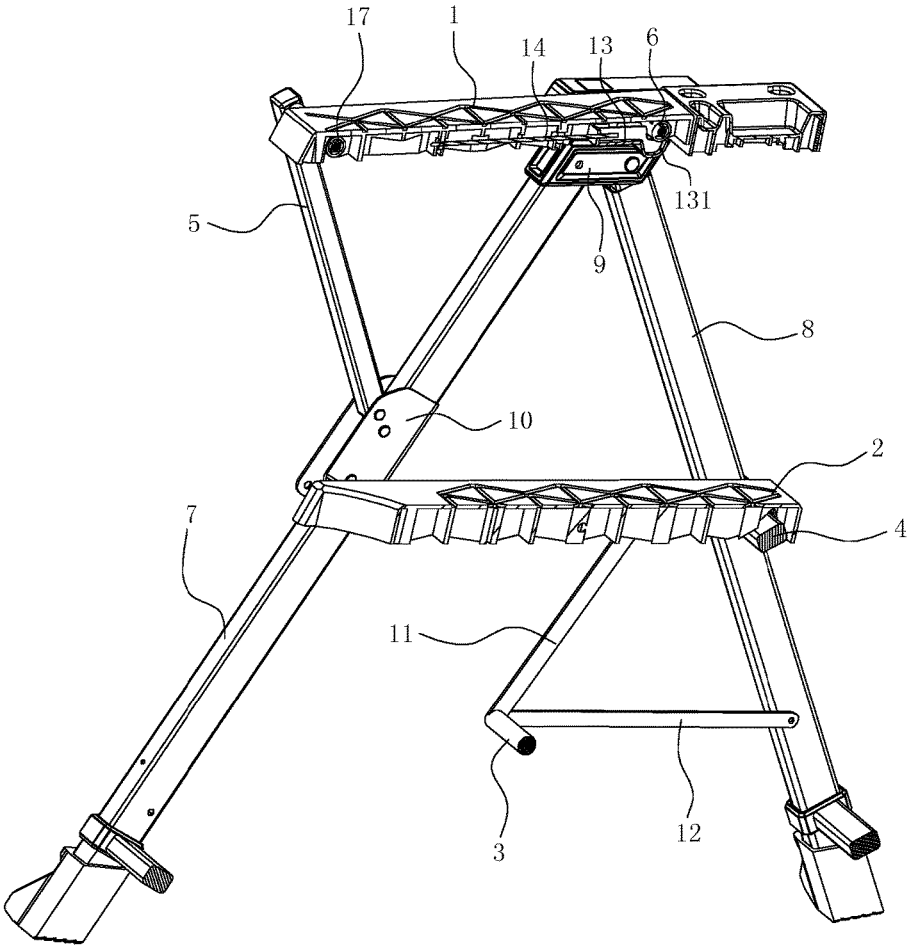
FIG. 6 is a perspective view of the working ladder of FIG. 5 when one portion of the working ladder is cut off.

As shown in FIGS. 5 and 6, when the working ladder serves as a working platform, the handle 15 is pulled forward by a hand; the handle 15 drives the holders 13 to move forward; and the stoppers 131 of the holders 13 move forward to leave the underneath of the bottom rear shaft 3, that is, the stoppers 13 does not restrict the bottom rear shaft 3 anymore. Meanwhile, a hand is put into the first bore 16 of the bottom step 1 to pull the bottom step 1 upward, so that the bottom step 1 is separated from the bottom rear shaft 3, then extended out from the front of the ladder frame body and turned up. Turning the bottom step 1 up drives the movable auxiliary support rods 5 to turn up, until the bottom step 1 is turned over the ladder frame body. Then, the rear end of the bottom step 1 rests on the auxiliary shaft 6, and the auxiliary shaft 6 is inserted into the limiting openings 18 of the bottom step 1. The handle 15 is pushed backward, the handle 15 drives the holders 13 to move backward, and the stoppers 131 of the holders 13 moves backward to the underneath of the auxiliary shaft 6, so that the rear end of the bottom step 1 is positioned on the auxiliary shaft 6. The front end of the bottom step 1 is supported by the movable auxiliary support rods 5, while the rear end thereof is supported by the auxiliary shaft 6. Thus, the bottom step 1 may serve as a working platform which allows a user to perform operations such as sawing, cutting or carving on this platform.

Figure 7:
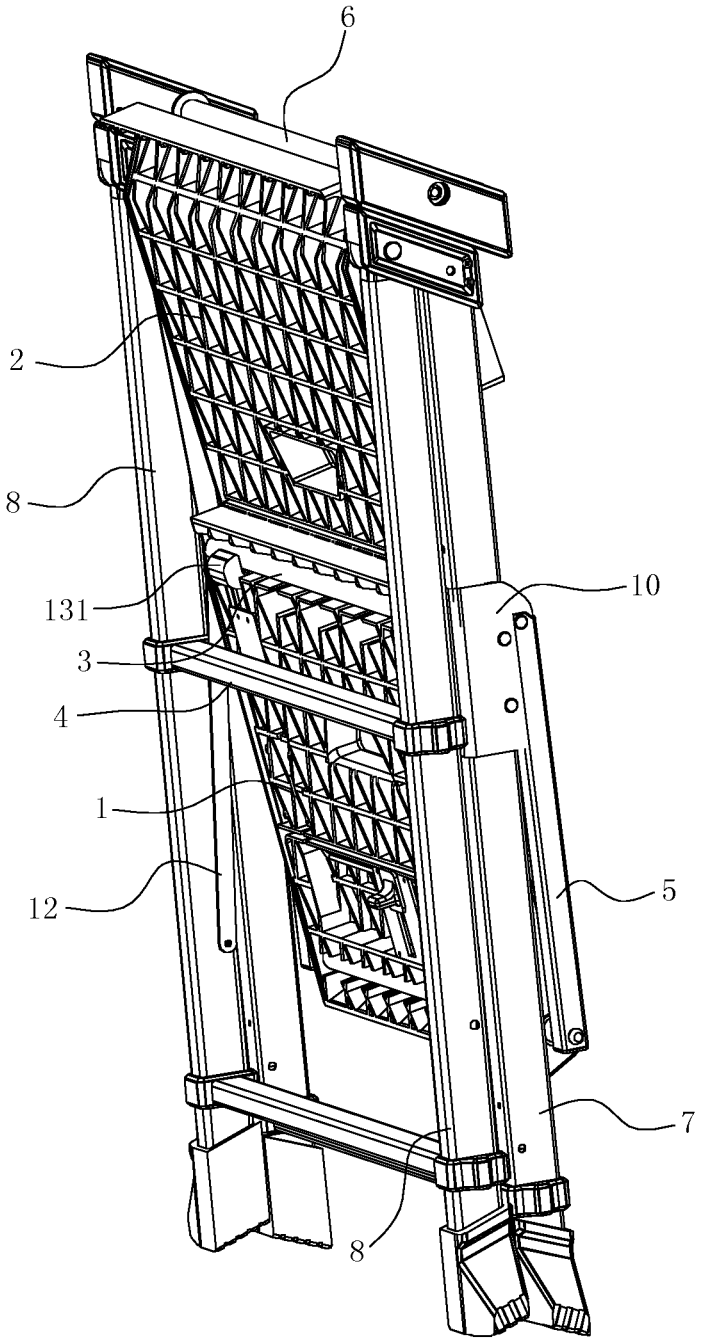
FIG. 7 is a perspective view of the working ladder according to the embodiment of the present invention (when the working ladder is folded).

As shown in FIG. 7, during folding, a hand is put into the second bore 21 on the upper step 2 to pull the upper step 2 upward. The rear end of the upper step 2 is separated from the bottom rear shaft 3 and the upper step 2 moves upward, and meanwhile the front side rails 7 and the rear side rails 8 are folded. The upper step 2 drives the bottom step 1 to move upward through the upper connecting rods 11 and the lower connecting rods 12 until the working ladder is folded. The folding way is similar to that of the existing working ladders.

The protection scope of the present invention is not limited to each embodiments described in this description. Any changes and replacements made on the basis of the scope of the present invention patent and of the description shall be included in the scope of the present invention patent.

The invention claimed is:

1. A working ladder capable of serving as a working platform, comprising:

a ladder frame body which can be expanded and folded, having a front portion and a top; and a step assembly which is disposed on the ladder frame body and able to be folded;

wherein, the step assembly comprises at least two steps, each step having a front end and a rear end, arranged one above another at intervals, and a rear shaft for the rear end of each step to rest on;

a bottommost step is a bottom step, and a step located above the bottom step is an upper step;

the rear shaft comprises a bottom rear shaft for the rear end of the bottom step, an upper rear shaft for the rear end of the upper step;

two movable auxiliary support rods capable of swinging up and down are disposed in the front portion of the ladder frame body, the front end of the bottom step is rotatably disposed between the two auxiliary support rods, and an auxiliary shaft for the rear end of the bottom step to rest on is horizontally disposed on the top of the ladder frame body;

when the auxiliary support rods are in a downward position, the rear end of the bottom step rests on the lowermost bottom rear shaft;

when the auxiliary support rods are in a upwardly position, the bottom step moves upwardly to the top of the ladder frame body, and meanwhile the rear end of the bottom step rests on the auxiliary shaft.

2. The working ladder of claim 1, wherein the ladder frame body comprises a pair of front side rails and a pair of rear side rails, the side rails of each pair are separated from each other into two sides, two side rails on a same side are hinged together, and the auxiliary support rods are rotatably arranged on front end surfaces of the front side rails.

3. The working ladder of claim 2, wherein the front end of the upper step is rotatably disposed between the two front side rails;

the upper rear shaft is fixed between the two rear side rails;

two upper connecting rods are rotatably connected to left and right sides of the upper step adjacent to the bottom step;

two lower connecting rods are rotatably connected to lower portions of the two rear side rails;

an end of an upper connecting rod of said two upper connecting rod and an end of a lower connecting rod of said two lower connecting rod on a same side are both rotatably connected to one side of the bottom rear shaft through a rotating shaft.

4. The working ladder of claim 3, wherein each of the two front side rails is fixed with an U-shaped fixed plates;

the left and right sides of the front end of the upper step are rotatably disposed on the fixed plates, respectively;

the auxiliary support rods are rotatably disposed within U-shaped grooves of the fixed plates.

5. The working ladder of claim 2, wherein the top of the front side rail and the top of the rear side rail on a same side are hinged together through a connecting member which is fixed on the top of the front side rail, and the top of the rear side rail is rotatably connected to the connecting member.

6. The working ladder of claim 1, wherein a first bore forming a first handle for pulling the bottom step is formed on the bottom step, and a second bore forming a second handle for pulling the upper step is formed on the upper step.

7. The working ladder of claim 1, wherein a surface of the front end of the upper step adjacent to the bottom step is arranged with recessed sections which are bent inwardly.

8. The working ladder of claim 1, wherein a connection structure for detachably connecting the bottom rear shaft or the auxiliary shaft is disposed on the bottom surface of the bottom step.

9. The working ladder of claim 8, wherein the connection structure comprises two holders and a driving structure for driving the holders to slide forward and back;

limiting openings running through a width direction of the bottom step and having a shape matched with the bottom rear shaft or the auxiliary shaft are disposed on the bottom surface of the bottom step;

the holders are positioned on the bottom surface of the bottom step and are able to slide forward and back;

two stoppers extending to the underneath of the limiting openings are disposed in rear portions of the holders;

when the bottom rear shaft or the auxiliary shaft is located within the limiting openings, the stoppers are located below the bottom rear shaft or the auxiliary shaft.

10. The working ladder of claim 9, wherein the driving structure comprises a pull rod attached to the holders, and the pull rod is positioned on the bottom surface of the bottom step and able to slide front and back;

a handle is connected to a tail end of the pull rod, and the handle is also positioned on the bottom surface of the bottom step and able to slide forward and back;

the pull rod is U-shaped, and one of the holders is fixed on each of two straight rod portions of the pull rod;

the handle is connected to a middle portion of a horizontal rod portion of the pull rod.

* * * * *